US005671560A

United States Patent [19]

Meller

[11] Patent Number: 5,671,560

[45] Date of Patent: Sep. 30, 1997

[54] FIREARM WITH SAFETY DEVICE

[75] Inventor: Yehuda Meller, Holon, Israel

[73] Assignees: Binyamin Yirmiyahu; Mordechai Yirmiyahu, both of Israel; part interest to each

[21] Appl. No.: 720,452

[22] Filed: Sep. 30, 1996

Related U.S. Application Data

[63] Continuation-in-part of Ser. No. 372,761, Jan. 13, 1995, Pat. No. 5,581,927.

[51] Int. Cl.[6] ..... F41A 17/00

[52] U.S. Cl. ..... 42/70.11; 42/70.01; 42/66; 42/70.06; 42/70.08

[58] Field of Search ..... 42/70.11, 70.01, 42/66, 70.06, 70.08; 89/148

[56] References Cited

U.S. PATENT DOCUMENTS

| | | | |
|---|---|---|---|
| 774,712 | 11/1904 | Vold . | |
| 2,945,316 | 7/1960 | Mulno | 42/66 |
| 3,462,869 | 8/1969 | Wallace | 42/70 |
| 3,673,725 | 7/1972 | Cravener | 42/1 R |
| 4,261,127 | 4/1981 | Karkkainen | 42/1 LP |
| 4,321,764 | 3/1982 | Wilhelm | 42/69 B |
| 4,384,420 | 5/1983 | Von Muller | 42/1 LP |
| 4,532,729 | 8/1985 | Von Muller | 42/1 LP |
| 4,833,811 | 5/1989 | Wilkinson | 42/70.08 |
| 4,926,575 | 5/1990 | Pastor | 42/70.06 |
| 4,972,618 | 11/1990 | Justice, Sr. et al. | 42/70.11 |
| 5,081,779 | 1/1992 | Pack | 42/70.11 |
| 5,235,763 | 8/1993 | Nosler et al. | 42/70.11 |
| 5,361,525 | 11/1994 | Bowes | 42/70.11 |

FOREIGN PATENT DOCUMENTS

| | | |
|---|---|---|
| WO82/03120 | 9/1982 | WIPO . |
| WO91/14146 | 9/1991 | WIPO . |

*Primary Examiner*—Charles T. Jordan
*Assistant Examiner*—Meena Chelliah
*Attorney, Agent, or Firm*—Benjamin Barish

[57] ABSTRACT

A firearm including a frame having a grip for manually grasping the firearm, a control member movable to enable firing the firearm, a locking device including a latch element movable by an inserted key either to a locking position or to a releasing position, and a locking member movably carried by the frame. A spring urges the locking member into contact with the control member such that the locking member moves with the control member to enable firing the firearm. The locking member is located with respect to the latch element of the locking device so as to be engaged thereby when the latch element is in its locking position, to block the movement of the locking member, and thereby to prevent the firing of the firearm when the latch element is in its locking position. Two embodiments are described: a semi-automatic pistol, wherein the control member is a pivotal safety lever; and a revolver, wherein the control member is a rebound slide.

19 Claims, 7 Drawing Sheets

FIREARM WITH SAFETY DEVICE

RELATED APPLICATION

The present application is a continuation-in-part of my patent application Ser. No. 08/372,761, filed Jan. 13, 1995, patented on Dec. 10, 1996, U.S. Pat. No. 5,581,927.

FIELD AND BACKGROUND OF THE INVENTION

The present invention relates to firearms, and particularly to a firearm equipped with a safety device which may be used for disabling the firearm from firing a cartridge.

Firearms are presently widely available among civilians as well as law enforcement agents and military personnel. They therefore represent a serious danger to children and others who may have unauthorized access to the firearm. A common way to prevent accidental firing of a firearm is to remove from it an essential operative component, such as the magazine of a pistol, and to keep it separate from the firearm itself. However, in such case the firearm is not ready for use should a need suddenly arise; morever, the separated component may get lost or misplaced. Another known safety means for disabling a firearm from firing a cartridge is an add-on locking device mounted on the trigger guard to prevent access to the trigger. However, in order to enable the firearm for use, the add-on device must be physically removed and placed at a suitable location for ready re-use whenever necessary, which is not only time-consuming and inconvenient, but may also result in the misplacement or loss of the removed device.

Other techniques for disabling a firearm include the insertion of an insert into a firearm's firing chamber or magazine chamber which insert must be withdrawn to enable the firearm to be used. However, an insert into the firing chamber may damage the rifling of the firing chamber. Moreover, such inserts must be separately stored and/or carried by the user, which is not always convenient, and which can also result in the loss or misplacement of the insert.

OBJECTS AND BRIEF SUMMARY OF THE INVENTION

An object of the present invention is to provide a firearm with a safety device having advantages in the above respects. Another object of the invention is to provide a safety device for a firearm which can be applied to many diverse types of firearms, particularly automatic pistols and revolvers.

According to the invention of the present application, there is provided a firearm including a frame having a grip for manually grasping the firearm, and a control member movable from a first position to a second position to enable firing the firearm; characterized in that the firearm further includes: a locking device carried by the frame for receiving a removable key. The locking device includes a latch element movable by an inserted key either to a locking position or to a releasing position. The firearm further includes a locking member movably carried by the frame, and a spring acting on the locking member to bring a first surface of the locking member into contact with the control member such that the locking member moves with the control member from the first position to the second position to enable firing the firearm. The locking member includes a second surface located with respect to the latch element of the locking device so as to be engaged thereby when the latch element is in its locking position, to block the movement of the locking member, and thereby of the control member, from the first position to the second position, to prevent the firing of the firearm when the latch element is in its locking position.

According to further features in one described preferred embodiment particularly useful in automatic pistols, the control member is a safety lever pivotally carried by the frame and manually presettable from an "OFF" first position to an "ON" second position to enable firing the firearm.

In a second described embodiment particularly useful in revolvers, the control member is a rebound slide which is reciprocated during the trigger pull from the first position to the second position and back to the first position.

It will thus be seen that a firearm constructed in accordance with the foregoing features does not require any add-on locking device or insert which has to be separately removed and stored in order to enable the firearm; but rather requires merely a key, which can be conveniently carried by the user with the many other keys the user normally carries. Thus, the firearm may be stored in its disabled condition and quickly enabled whenever necessary by an authorized person by merely inserting and rotating the key. Such a key would generally be carried by the user with the user's other keys, thereby adding no significant burden to the authorized user, and also decreasing the possibility of losing or misplacing the key, as compared to where an add-on locking device or an insert is needed for disabling the firearm.

As will be described more particularly below, such a locking device may be applied in a very simple manner to a wide variety of different types of firearms, particularly automatic pistols and revolvers. For purposes of example, two different types of firearms are described below showing how each may accommodate the locking device in order to disable the firearm from being used for firing a cartridge.

Further features and advantages of the invention will be apparent from the description below.

BRIEF DESCRIPTION OF THE DRAWINGS

The invention will now be described, by way of example only, with reference to the accompanying drawings wherein.

DESCRIPTION OF SPECIFIC EMBODIMENTS

Figure 1:
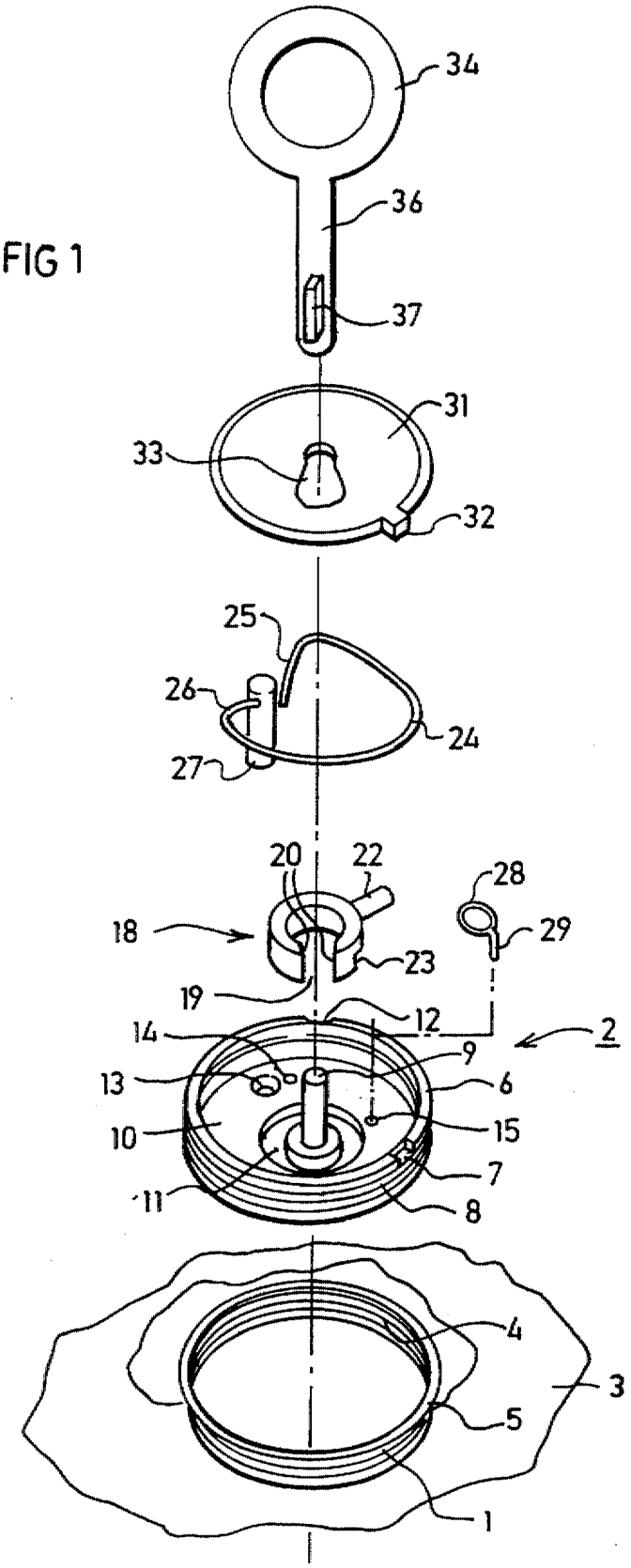
FIG. 1 is an exploded perspective view of one form of lock constructed in accordance with the present invention.

Reference is first made to FIGS. 1–4 of the drawings for a description of the structure and operation of a lock constructed according to the present invention. The lock, generally designated 2, fits into a cylindrical cavity in the form of a sleeve 1 securely held by a structural part 3 of the firearm, such as the sidewall of a pistol grip. Sleeve 1 is formed with internal threads 4 and a projecting rim 5. Lock 2 comprises a cup-shaped housing 6 having at its upper edge a rectangular cutout 7 and is formed with external threads 8 enabling it to be threaded into sleeve 1. Housing 6 is formed with a notch 12 receiving a pin (not shown) for retaining the housing in place.

Housing 6 comprises an integral central stem 9 projecting from a bottom wall 10 formed with a concentric annular groove 11. Bottom wall 10 is further formed with a first cylindrical bore 13 and two smaller bores 14 and 15. A horseshoe-shaped actuator 18, formed with a slot 19 between cheeks 20, is rotatably mounted with the annular groove 11. Actuator 18 has a laterally projecting finger 22 and an indentation 23 on its outer face.

Within the housing 6 there is located a single turn helical spring 24 having a first, vertical end portion 25 received in a bore 14, and a second, horizontal end portion 26 received in a hole of a cylindrical latch element 27 reciprocable within bore 13.

A looped retainer spring 28, having a shank 29 received within bore 15, is designed to retain actuator 18 in either of two angular positions by snappingly engaging either the indentation 23 or the slot 19 of actuator 18. A cover plate 31, with a tongue 32 fitting into cutout 7 and a keyhole 33, covers housing 6 from above. Keyhole 33 is designed to admit the hollow shank 36 of a key 34 receivable over stem 9 and having a key bit 37 receivable in slot 19 of actuator 18.

Figure 2:
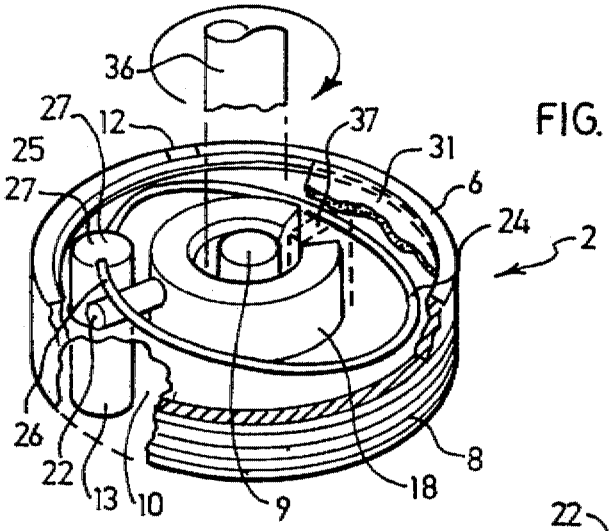
FIG. 2 is a fractional perspective view of the lock of FIG. 1 shown in the unlocked state.

The operation of lock 2 will now be explained with reference to FIGS. 2 and 3.

As shown, finger 22 of actuator 18 is positioned underneath the single turn helical spring 24. When the key 34 is inserted into the keyhole 33, its bit 37 penetrates into slot 19 of the actuator 18 bearing on the two cheeks 20. Turning the key 34 causes actuator 18 to rotate with its finger 22 gliding along the single turn helical spring 24. When the key 34 is turned clockwise all the way until the finger 22 of actuator 18 abuts latch element 27 as shown in FIG. 2, the horizontal end portion 26 of the single turn helical spring 24 is lifted pulling with it latch element 27, which is thereby moved to its retracted position within housing 6.

Figure 3:
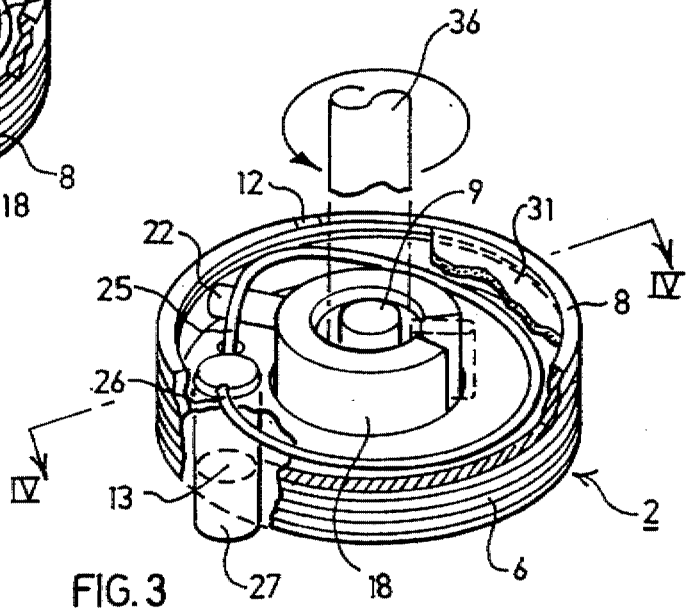
FIG. 3 is a similar view as FIG. 1 showing the lock in the locked state.
Figure 4:
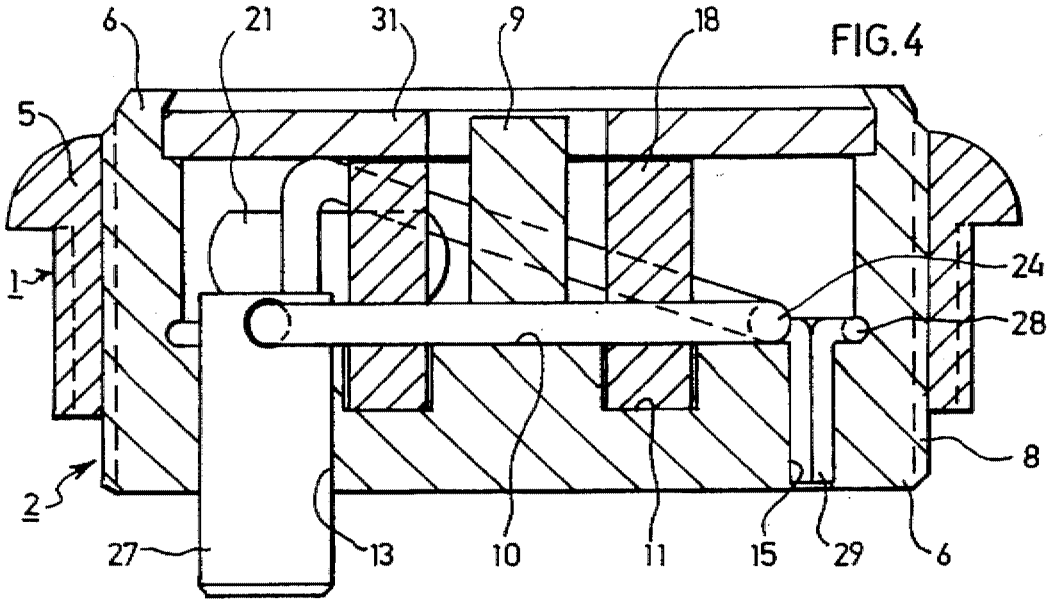
FIG. 4 is a cross-section along line IV—IV in FIG. 3.

When the key 34 is turned all the way anti-clockwise until finger 22 abuts the vertical end portion 25 of the single turn helical spring 24 as shown in FIG. 3, the end portion 26 is urged down, whereby latch element 27 is urged to its projected position through bore 13. If latch element 27 is designed to engage a matching bore or opening, and the bore or opening is out of register with bore 13 so that the latch element encounters an obstacle, it will remain retracted until the matching bore or opening is brought into register with bore 13.

Pre-adjusting the lock, so that the latch element 27 projects in register with the opening of the essential operative component, is carried out by angularly displacing the lock 2 within the sleeve I until the latch element 27 eccentically projecting from the lock comes into register with the opening. The angular position of the lock may then be fixed by slightly indenting rim 5 into recess 12 of the housing 6.

Obviously, the lock may be provided with a ward or other means for making it more sophisticated and untamperable, and the key be shaped accordingly, all as known per se.

FIGS. 5–10 of the drawings illustraate how the present invention may be applied to different kinds of firearms. For the sake of clarity and simplicity of illustration, those parts of the weapons illustrated which are known per se and not relevant to the present invention are not shown.

Figure 5:
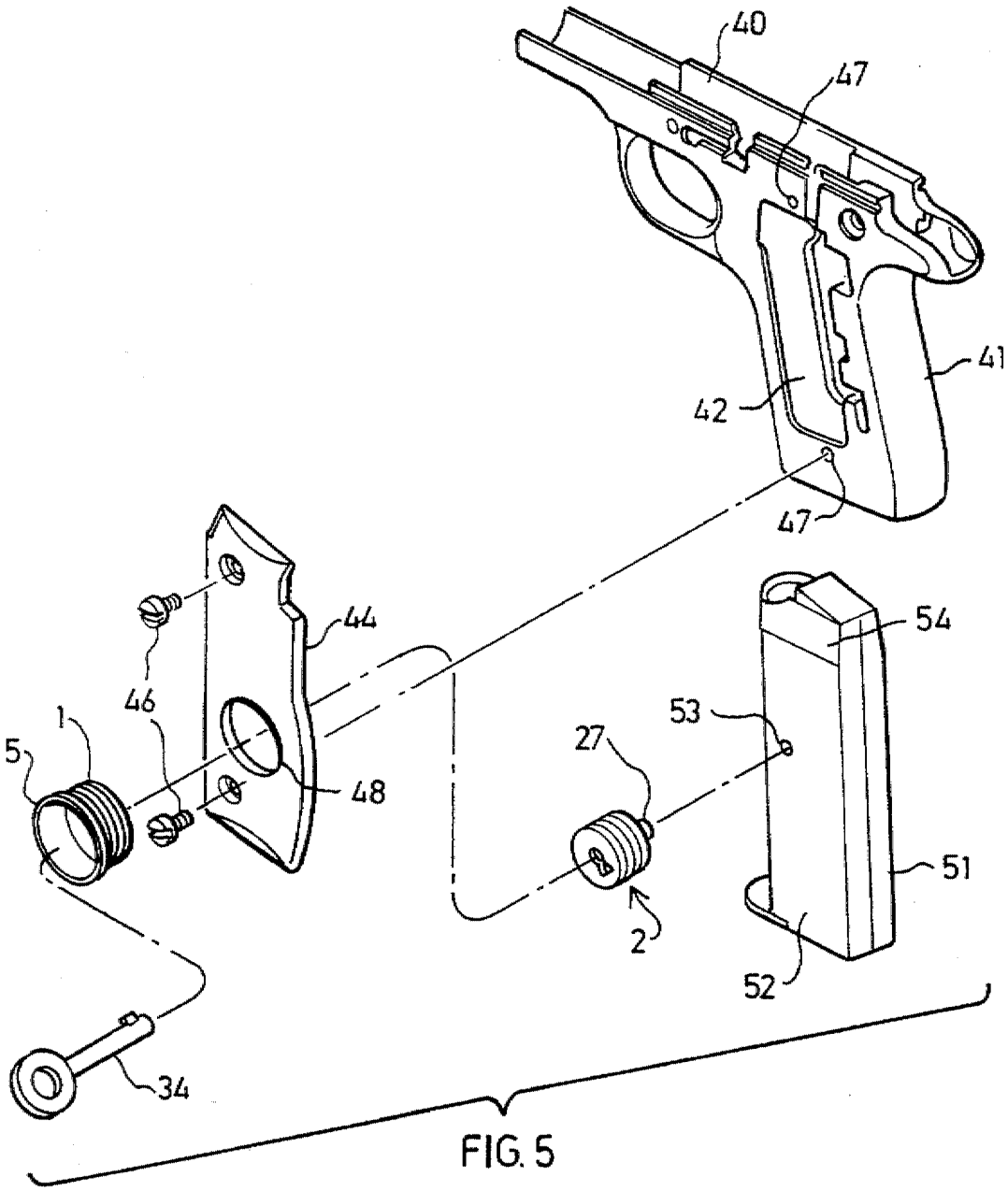
FIG. 5 is an exploded perspective view of an automatic pistol equipped with the lock of FIGS. 1–4.

In FIG. 5 there is shown an automatic pistol having a frame 40 with a grip 41 holding a magazine chamber 42 and fitted with a pair of removable sidewalls 44 (only one of which is shown) attached by screws 46 engaging suitably threaded holes 47 in the frame. The sidewall 44 has a circular cutout 48 which securely holds the sleeve 1 with the rim 5 bearing against the external surface of the sidewall 44. The housing 6 of lock 2 is screwed into the sleeve 1.

A magazine 51 has, on its sidewall 52 facing the removable sidewall 44 of grip 41, an opening 53 for engagement by latch element 27.

When required, lock 2 is locked by means of key 34 whereby the latch element 27 is urged to project into the magazine chamber 42. This operation may be performed either with the magazine 51 present in the magazine chamber 42, or with an empty magazine chamber.

If the locking operation is performed with a magazine fully inserted in the magazine chamber 42, latch element 27 bears on the magazine's sidewall 52; therefore, the magazine must then be partially withdrawn until opening 53 comes into register with latch element 27, whereupon the latch element spontaneously snaps into opening 53; this would arrest the magazine in an intermediate, inoperative position.

If, on the other hand, the locking operation is caried out while the magazine chamber 42 is empty, then upon locking, latch element 27 projects into the magazine chamber 42; upon insertion of a magazine, the latch element 27 glides over the sloping lips 54 of the magazine and snaps into hole 53 as soon as the latter registers with the latch element, again arresting the magazine in an intermediate, inoperative position.

It is an advantage of this locking arrangement that in addition to the pistol becoming inoperative, the cartridges within the arrested magazines are out of reach for as long as the pistol remains locked.

Figure 6:
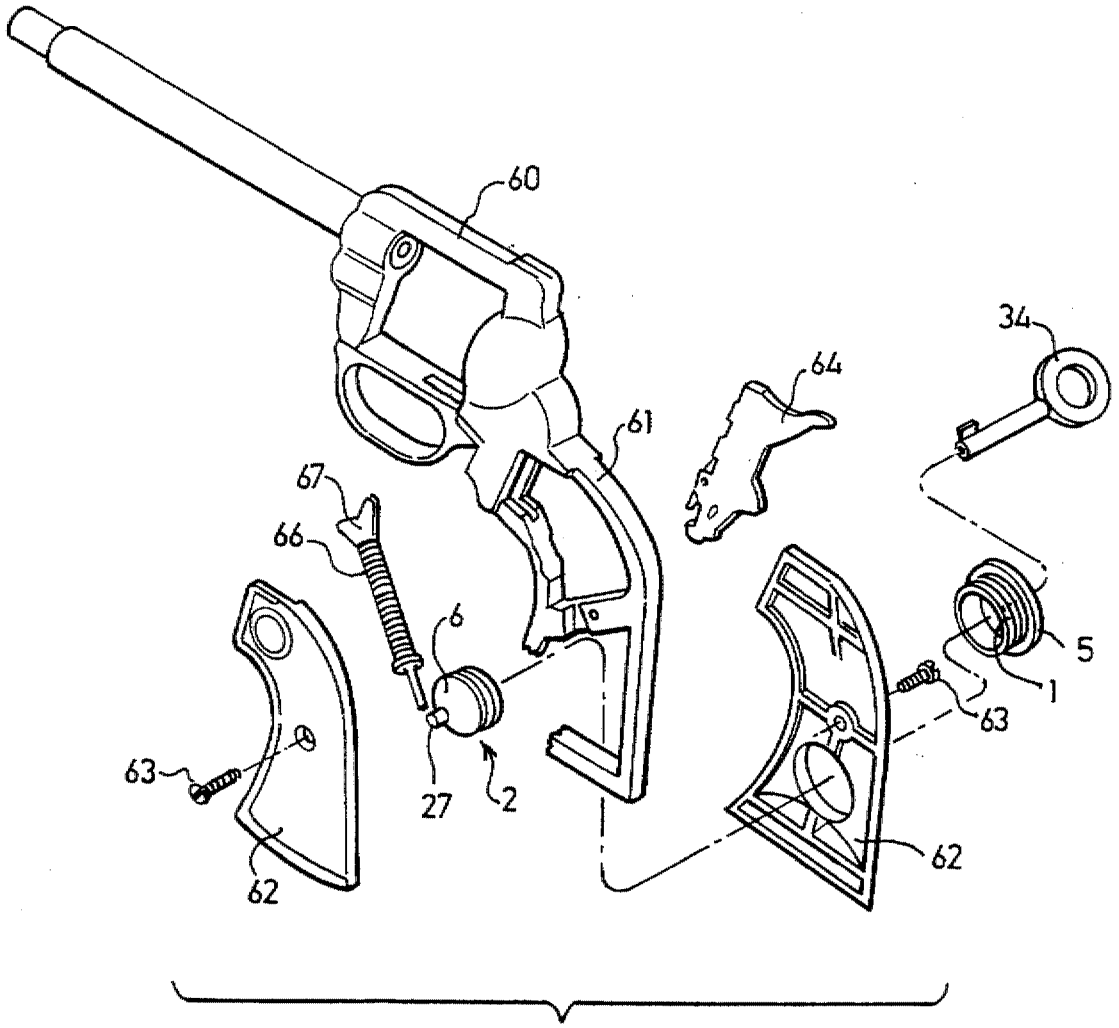
FIGS. 6–8 are exploded perspective views illustrating three types of revolvers, respectively, equipped with the lock of FIGS. 1–4.
Figure 7:
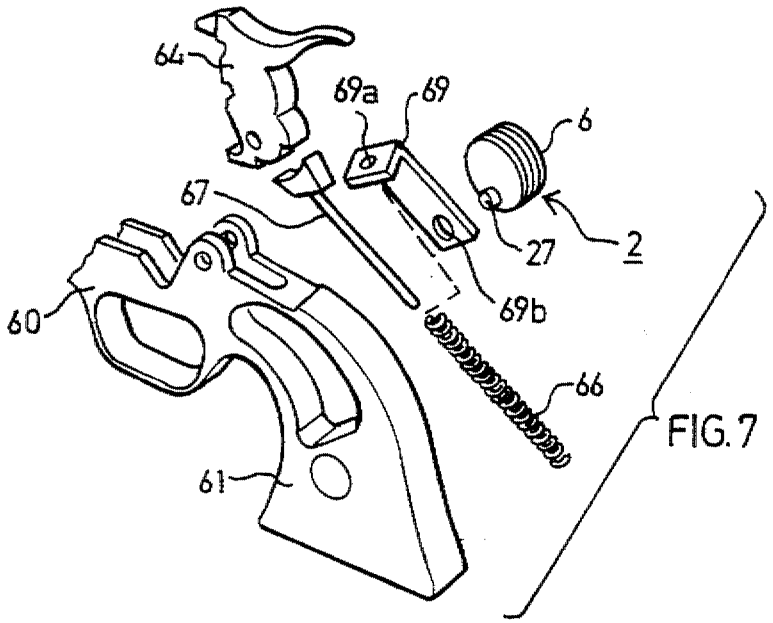
Figure 8:
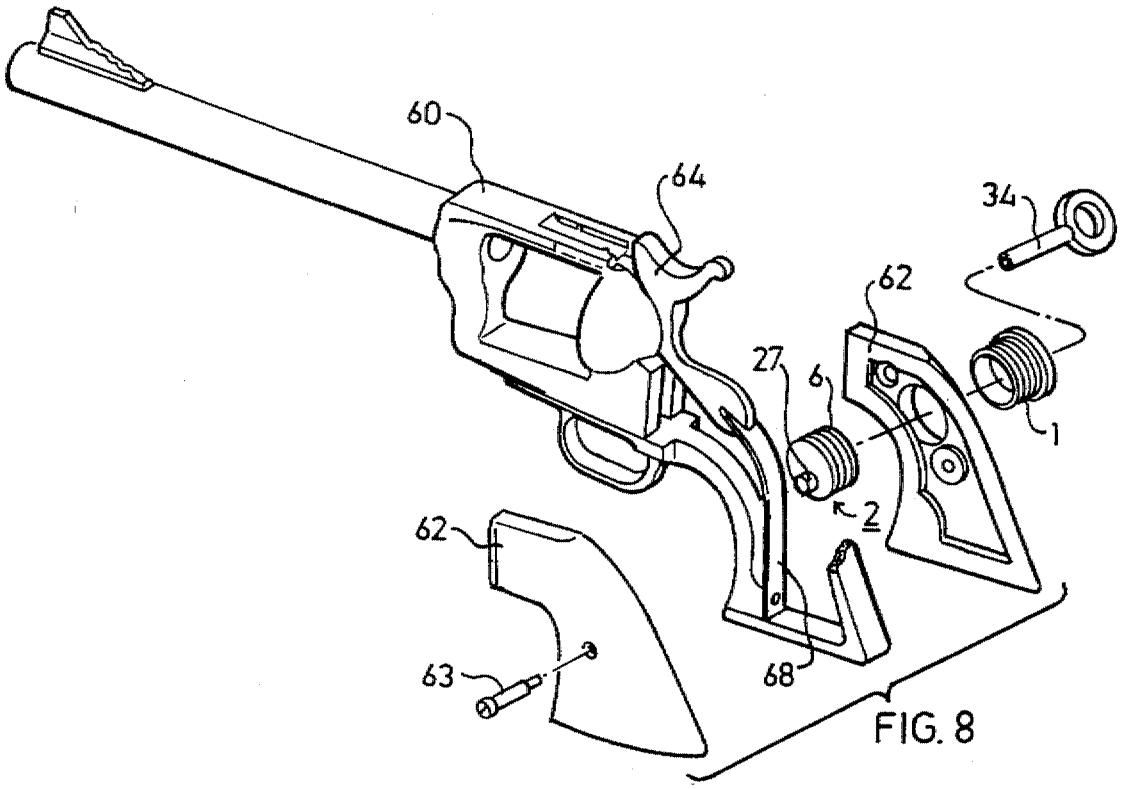

FIGS. 6–8 illustrate how the present invention may be applied to three different kinds of revolvers. To facilitate understanding, those components which are principally the same in these figures are designated by the same reference numerals.

Each revolver includes a revolver frame 60 having a grip 61 and removable sidewalls 62 attached to the grip by screws 63. Each revolver comprises a hammer 64 associated with a main spring which upon actuation propels the hammer to perform a forward striking motion, as known per se. The main spring is either a compression spring 66 mounted on a guiding rod 67 as shown in FIGS. 6 and 7, or a leaf spring 68 as shown in FIG. 8. In all three constructions, upon cocking the hammer 64, the main spring undergoes a deformation whereby it is loaded.

One of the sidewalls 62 is fitted with a lock 2 of the kind shown in FIGS. 1–4 and which functions in a similar manner as explained with respect to the automatic pistol of FIG. 5.

In the embodiment of FIG. 6, the latch element 27 of lock 2 is adapted for engagement with the rear end of the guiding rod 67 whereby, upon locking, latch element 27 prevents the main spring from being tensioned so that the hammer 64 may not be cocked and the revolver cannot be fired.

In the embodiment of FIG. 7, there is an L-shaped bracket 69 having in its foot portion a hole 71 whereby the bracket can be slid on the guiding rod 67. A hole 72 in the shank of bracket 69 serves for engagement by latch element 27 and upon such enagement the bracket is arrested whereby spring 66 is blocked and cannot be deformed. In consequence the hammer 64 cannot be cocked with the result that the revolver is disabled.

In the embodiment of FIG. 8, the latch element 27 is suited to bear, when in locking position, on the back of leaf spring 68 thereby preventing its deformation whereby the hammer 64 cannot be cocked and the revolver is disabled.

Figure 9:
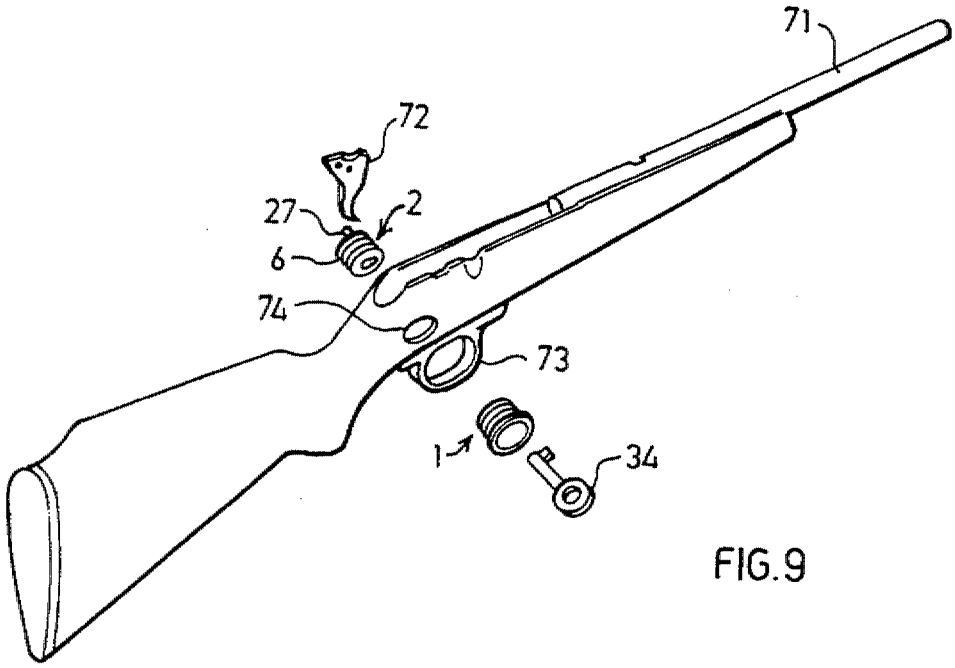
FIG. 9 is an exploded perspecive view of a rifle equipped with the lock of FIGS. 1–4.

FIG. 9 illustrates how the invention may be applied to a rifle. A body 70 including a barrel 71 and a firing mechanism, of which only a trigger 72 is shown, has on a sidewall thereon adjacent the trigger guard 73 an opening 74 for accommodating the sleeve 1 holding lock 2. The arrangement is such that in the locking or projecting position of latch element 27, it bears on the rear of the trigger 72, thereby preventing it from being the rifle is di the rifle is disabled.

Figure 10:
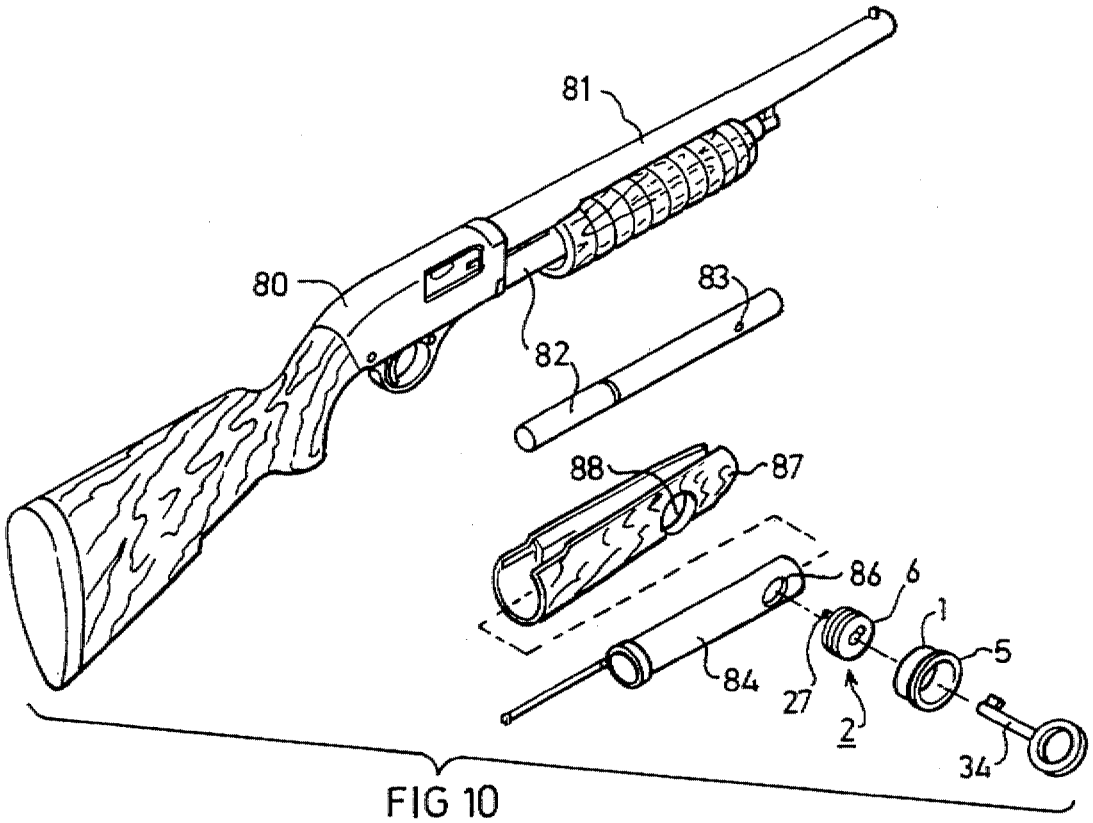
FIG. 10 is an exploded perspective view of a pump action rifle equipped with the lock of FIGS. 1–4.

FIG. 10 illustrates a rifle of the pump-action type comprising a body 80 holding a barrel 81 and a tubular magazine 82 having a lateral hole 83. Enveloping the tubular magazine 82 is a sliding lever 84 reciprocable between a forward position as illustrated in FIG. 10 and a rear portion. Each time the sliding lever 84 is reciprocated, the rifle is cocked and loaded; or alternatively, an empty cartridge is extracted and ejected.

The lever 84 has a hole 86 and is enveloped by a wooden hand guard 87 rigidly attached thereto and having a registering hole 88. Holes 86 and 88 accommodate between them the lock 2. Upon locking, the latch element 27 projects into the hole 83 of the tubular magazine 82 whereby the lever 84 is arrested and the rifle is disabled.

Figure 11:
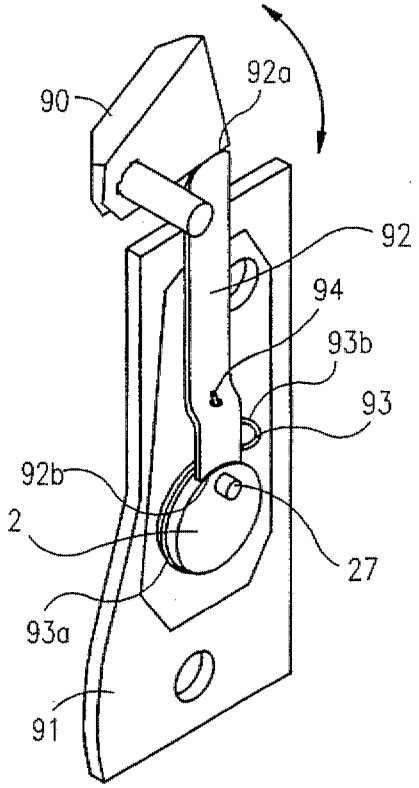
FIG. 11 is a perspective view illustrating how the lock of FIGS. 1–4 may be incorporated in an automatic pistol having a pivotal safety lever which is blocked to prevent firing the pistol.
Figure 12:
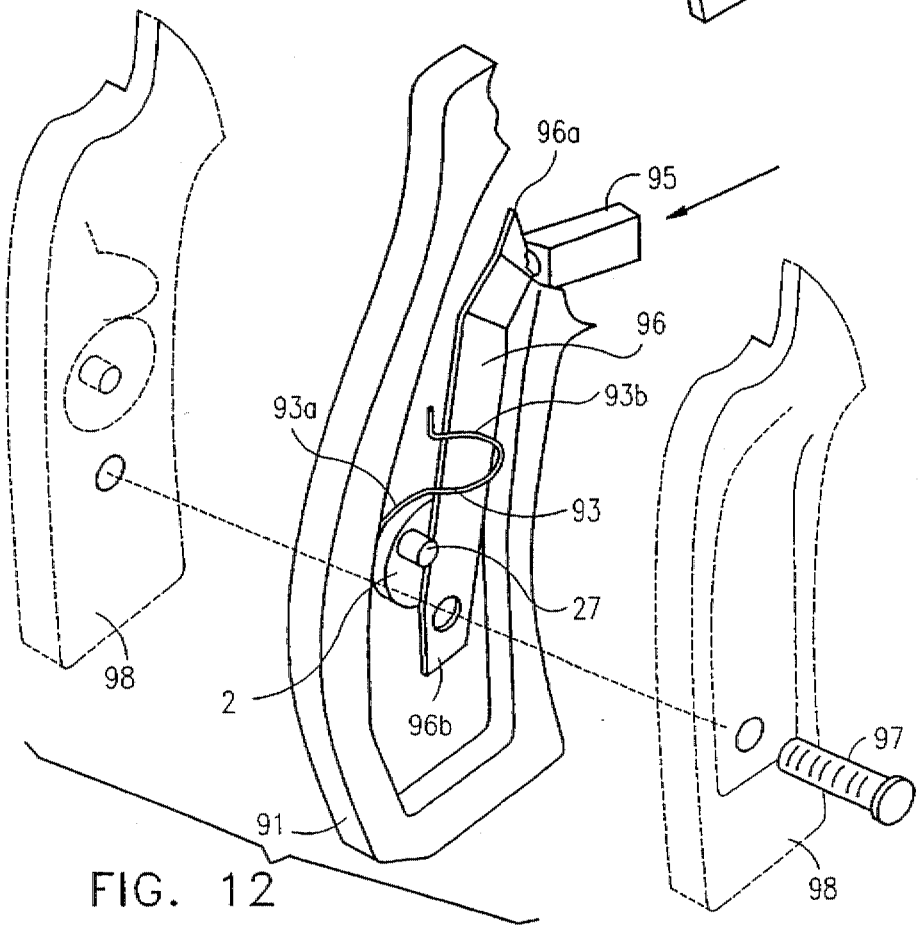
FIG. 12 is an exploded perspective view illustrating how the lock of FIGS. 1–4 may be incorporated in a revolver having a rebound slide which is blocked to prevent firing the revolver.

FIGS. 11 and 12 illustrate how the lock 2 of FIGS. 1–4 may be included in a firearm, particularly an automatic pistol or revolver, having a control member which must be moved from a first position to a second position to enable firing the firearm, wherein the lock blocks the movement of the control member to the second position and thereby prevents firing the firearm.

In FIG. 11, the firearm is an automatic pistol in which the control member is the pivotal safety lever 90 conventionally provided on such a pistol, which safety lever must be manually pivotted from its "OFF" to its "FIRING" position to enable firing the pistol. Here, the lock 2 is attached to the grip 91 of the pistol frame in the manner described above such that its latch element 27 is in its projected position (as shown in FIG. 11) when the lock is in its locked condition, and is moved to its retracted position within the lock housing when the lock is in its released condition.

The grip 91 of the automatic pistol illustrated in FIG. 11 is provided with a locking member in the form of a bar 92 interposed between latch element 27 and the pivotal safety lever 90. A spring 93 continuously urges the upper surface **92*a* of the locking bar into engagement with the pivotal safety lever. One end of spring 93 is in the form of a coil or loop 93*a* which encloses the cylindrical housing of lock 2, and the opposite end of the spring is formed with an extension 93*b* received within an opening 94 in locking bar 92 for urging surface 92*a* of the locking bar against the pivotal safety lever 90, with the opposite end 92*b* of the locking bar in alignment with the latch element 27** of the lock.

Safety lever 90 is shown in FIG. 11 in the position in which it prevents firing the pistol. For purposes of simplifying the present description, the structure by which safety lever 90 prevents firing the pistol is not set forth herein since such structure is conventional and forms no part of the present invention.

In order to enable firing the pistol, safety lever 90 must be manually pivotted (clockwise, FIG. 11). Since surface **92*a* of locking bar 92 is continuously urged by spring 93 against the underside of safety lever 90, this pivotting of the safety lever will also move the locking bar 92 downwardly. If latch element 27 of lock 2 is in its released position, retracted within the lock, the latch element will not interfere with the downward movement of locking bar 92, and will therefore permit the manual pivotting of the safety lever to its "FIRING" position. However, if latch element 27 is in its locking position, projecting from the lock as shown in FIG. 11, it will block locking bar 92 from moving downwardly, and thereby prevent the safety lever 90** from being pivotted to its "FIRING" position.

FIG. 12 illustrates the lock 2 attached to the grip 91 of a revolver having a rebound slide 95 which is reciprocated during the trigger pull of the pistol from a first position (shown in FIG. 12) to a second position by the trigger movement of the pistol. Again, for simplifying the description, the mechanism by which the rebound slide 95 is to be reciprocated during the firing of the pistol is not set forth herein as such mechanism is conventional and forms no part of the present invention.

According to the present invention, the grip 91 is provided with a pivotal locking lever 96 pivotally mounted at its lower end to the grip by the screw 97 attaching the two removable side walls 98 to the grip. The revolver of FIG. 12 further includes spring 93 having a coil **93*a* at one end enclosing lock 2 and an extension 93*b* at the opposite end engageable with locking lever 96 for urging the locking lever against the rebound slide 95. In this case, however, the extension 93*b* of spring 93 bears against a side of the locking lever 96 (rather than passing through a hole in it as shown in FIG. 11) to urge surface 96*a* at the upper end of the locking lever continuously against the rebound slide 95**.

Thus, in the released condition of lock 2, latch element 27 is retracted within the lock. This permits locking lever 96, having its surface **96*a* at its upper end continuously engaging rebound slide 95 under the influence of spring 93, to pivot about screw 97 during the reciprocatory movement of the rebound slide, thereby enabling the revolver to be fired. However, when lock 2 is in its locking position with its latch element 27 projecting from the lock as shown in FIG. 12, latch element 27 engages surface 96*b* of locking lever 96, preventing the locking lever from pivotting about screw 97, and thereby blocking the reciprocatory movement of the rebound slide 95** to prevent firing the revolver.

From the foregoing, it is readily understood that the present invention may be applied to different kinds of firearms.

While the invention has been described with respect to one preferred embodiment of lock structure, it will be appreciated that many changes may be made. For example, sleeve 1 may be omitted, and housing 6 applied directly to the firearm. In addition, retainer spring 28 could be omitted or replaced by a springy disc pressing actuator 18 into groove 11 in housing 6 for frictionally loading movement of the actuator. Further, a shaped leaf spring can be used for the wire spring 24, and a roll pin can be provided to be received within notch 12 to prevent rotation of the housing 6. Many other variations, modifications and applications of the invention will be apparent.

I claim:

1. A firearm including a frame having a grip for manually grasping the firearm, and a control member movable from a first position to a second position to enable firing the firearm; characterized in that said firearm further includes:

a locking device carried by said frame for receiving a removable key, said locking device including a latch element movable by an inserted key either to a locking position or to a releasing position;

a locking member movably carried by said frame;

and a spring acting on said locking member to bring a first surface of the locking member into contact with said control member such that the locking member moves with the control member from said first position to said second position to enable firing the firearm;

said locking member including a second surface located with respect to said latch element of the locking device so as to be engaged thereby when the latch element is in its locking position, to block the movement of the locking member, and thereby of the control member, from said first position to said second position, to prevent the firing of the firearm when the latch element is in its locking position;

said locking device including a cylindrical housing formed with external threads, and said grip including a cylindrical cavity formed with internal threads for threadedly receiving said housing.

2. The firearm according to claim 1, wherein said control member is a pivotal safety lever pivotally carried by said frame and manually presettable from an "OFF" first position to an "ON" second position to enable firing the firearm.

3. A firearm including a frame having a grip for manually grasping the firearm, and a control member movable from a first position to a second position to enable firing the firearm; characterized in that said firearm further includes:

a locking device carried by said frame for receiving a removable key, said locking device including a latch element movable by an inserted key either to a locking position or to a releasing position;

a locking member movably carried by said frame; and a spring acting on said locking member to bring a first surface of the locking member into contact with said control member such that the locking member moves with the control member from said first position to said second position to enable firing the firearm;

said locking member including a second surface located with respect to said latch element of the locking device so as to be engaged thereby when the latch element is in its locking position, to block the movement of the locking member, and thereby of the control member, from said first position to said second position, to prevent the firing of the firearm when the latch element is in its locking position;

said control member being a pivotal safety lever pivotally carried by said frame and manually presettable from an "OFF" first position to an "ON" second position to enable firing the firearm.

4. The firearm according to claim 3, wherein said locking device is carried by the grip of the firearm, and said locking member is interposed between the locking device and the pivotal safety lever.

5. The firearm according to claim 4, wherein said locking member is a locking bar having an upper end, constituting said first surface, in contact with the pivotal safety lever, and a lower end, constituting said second surface, engaged by the latch element of the locking device when in its locking position.

6. The firearm according to claim 5, wherein said locking device includes a cylindrical housing carried by the grip of the firearm, and said spring includes a coil at one end enclosing said housing, and an extension at the opposite end engaging said locking bar for urging said locking bar against said pivotal safety lever.

7. The firearm according to claim 6, wherein said cylindrical housing of the locking device is formed with external threads, and said grip includes a cylindrical cavity formed with internal threads for threadedly receiving said housing.

8. The firearm according to claim 6, wherein said cylindrical housing of the locking device is closed at its opposite ends by end walls, the length of the housing being substantially shorter than the transverse dimensions of said end walls; one of said end walls being formed with a keyhole for receiving said removable key, and the opposite end wall being formed with an opening through which said latch element projects to said locking position when moved by the inserted key.

9. The firearm according to claim 8, wherein said housing further includes a rotatable actuator having a finger engageable with said latch element; said actuator being rotatable by the insertion and rotation of a key via said keyhole to rotate the finger to move said latch element to its locking position by projecting said latch element through said opening in the housing, or to its releasing position retracting said latch element within said housing.

10. The firearm according to claim 1, wherein said control member is a rebound slide which is reciprocated during the firing of the firearm from said first position to said second position and back to said first position.

11. The firearm according to claim 10, wherein said locking device is carried by the grip of the firearm, and said locking member is interposed between the locking device and the rebound slide.

12. The firearm according to claim 11, wherein said locking member is a pivotal locking lever having an upper end formed with said first surface in contact with the rebound slide, said pivotal locking lever being pivotally mounted at its lower end and including an intermediate surface, constituting said second surface, engaged by the latch element when in its locking position.

13. The firearm according to claim 12, wherein said pivotal locking lever includes a cylindrical housing carried by the grip of the firearm, and said spring includes a coil at one end enclosing said housing, and an extension at the opposite end engaging said pivotal locking lever for urging said locking lever against said rebound slide.

14. The firearm according to claim 13, wherein said cylindrical housing of the locking device is formed with external threads, and said grip includes a cylindrical cavity formed with internal threads for threadedly receiving said housing.

15. The firearm according to claim 14, wherein said cylindrical housing of the locking device is closed at its opposite ends by end walls, the length of the housing being substantially shorter than the transverse dimensions of said end walls; one of said end walls being formed with a keyhole for receiving said removable key, and the opposite end wall being formed with an opening through which said latch element projects to said locking position when moved by the inserted key.

16. The firearm according to claim 15, wherein said housing further includes a rotatable actuator having a finger engageable with said latch element; said actuator being rotatable by the insertion and rotation of a key via said keyhole to rotate the finger to move said latch element to its locking position by projecting said latch element through said opening in the housing, or to its releasing position retracting said latch element within said housing.

17. The firearm according to claim 3, wherein said locking device includes a cylindrical housing formed with external threads, and said grip includes a cylindrical cavity formed with internal threads for threadedly receiving said housing.

18. The firearm according to claim 17, wherein said cylindrical housing of the locking device is closed at its opposite ends by end walls, the length of the housing being substantially shorter than the transverse dimensions of said end walls; one of said end walls being formed with a keyhole for receiving said removable key, and the opposite end wall being formed with an opening through which said latch element projects to said locking position when moved by the inserted key.

19. The firearm according to claim 18, wherein said housing further includes a rotatable actuator having a finger engageable with said latch element; said actuator being rotatable by the insertion and rotation of a key via said keyhole to rotate the finger to move said latch element to its locking position by projecting said latch element through said opening in the housing, or to its releasing position retracting said latch element within said housing.

* * * * *